United States Patent [19]

Dodd et al.

[11] Patent Number: 5,044,881

[45] Date of Patent: Sep. 3, 1991

[54] TURBOMACHINE CLEARANCE CONTROL

[75] Inventors: Alec G. Dodd, Derby; Terence R. Pellow, Watford, both of England

[73] Assignee: Rolls-Royce plc, London, England

[21] Appl. No.: 440,365

[22] Filed: Nov. 22, 1989

[30] Foreign Application Priority Data

Dec. 22, 1988 [GB] United Kingdom ..... 8829955

[51] Int. Cl.[5] ..... F01D 11/08

[52] U.S. Cl. ..... 415/173.3

[58] Field of Search ..... 415/173.1, 173.2, 173.3, 415/174.2, 9, 12, 178

[56] References Cited

U.S. PATENT DOCUMENTS

| | | | |
|---|---|---|---|
| 3,146,992 | 9/1964 | Farrell | 415/12 |
| 3,656,862 | 4/1972 | Rahaim et al. | 415/173.2 |
| 4,332,523 | 6/1982 | Smith | 415/173.3 |
| 4,529,355 | 7/1985 | Wilkinson | 415/173.3 |
| 4,553,901 | 11/1985 | Laurello | 415/173.2 |
| 4,687,412 | 8/1987 | Chamberlain | 415/173.2 |
| 4,844,688 | 7/1989 | Clough et al. | 415/173.2 |
| 4,925,365 | 5/1990 | Crozet et al. | 415/173.6 |

FOREIGN PATENT DOCUMENTS

| | | | |
|---|---|---|---|
| 2554563 | 6/1976 | Fed. Rep. of Germany | 415/173.3 |
| 2080439 | 7/1981 | United Kingdom . | |
| 2104966 | 3/1983 | United Kingdom | 415/173.2 |
| 2206651 | 7/1987 | United Kingdom . | |

*Primary Examiner*—John T. Kwon

*Attorney, Agent, or Firm*—Cushman, Darby & Cushman

[57] ABSTRACT

The low pressure turbine of a gas turbine engine has an array of rotor blades and a shroud which surrounds the blade tips. The shroud is made up of a plurality of segments which are pivotally mounted from the turbine casing at their midpoints. The upstream portions of the shroud segments are fixed to the casing so that localised cooling of the casing in the region of pivotal attachment of the shroud segments causes the shroud segments to tilt and thereby improve the gas seal between the tips of the rotor blades and the shroud segments.

9 Claims, 2 Drawing Sheets

TURBOMACHINE CLEARANCE CONTROL

This invention relates to turbomachine clearance control and has particular relevance to the control of the clearance between the tips of an annular array of rotor aerofoil blades and the casing which conventionally surrounds them.

BACKGROUND OF THE INVENTION

It is well known that one of the critical factors governing the efficiency of a turbine, particularly the turbine of an axial flow gas turbine engine, is the magnitude of the clearance between the radial outer tips of the turbine rotor blades and the radially inner surface of the casing which surrounds them. If the clearance is too large, there can be a leakage of turbine gases between the turbine blade tips and the casing resulting in turn in a reduction in turbine efficiency. It is of course possible to build the turbine in such a manner that the clearance is very small. However the thermal changes which inevitably occur during gas turbine engine operation result in the variation of the clearance. If the clearance is too small, there is a very real danger of the turbine blade tips actually making contact with the casing.

Several approaches have been made in the past to the control of turbine blade tip clearance by blowing hot or cold air on to the external surface of the turbine casing so as to control its temperature and thereby in turn its thermal expansion. For instance in UK Patent No. 1248198 there is described a turbine blade tip clearance control system in which the clearance between the turbine blade tips and surrounding casing is measured and the resultant measured value is used to control a device which directs hot or cold air on to the casing. The actual air temperature is selected such that the casing thermally expands or contracts to such an extent that the tip clearance is maintained at a pre-selected value. Similarly in UK Patent No. 1561115 there is described a clearance control system in which cool air is directed on to the turbine casing in order to reduce the rate at which the casing thermally expands. The actual amount of cooling directed on to the casing is controlled in accordance with an engine operating parameter.

Although such techniques for controlling turbine blade tip clearance can be effective, it is sometimes difficult to ensure that thermal expansion and contraction of the turbine casing is sufficiently large as to provide an optimum turbine blade tip clearance under the majority of engine operating conditions.

It is an object of the present invention to provide means for controlling turbine blade tip clearance in which an optimum clearance is achievable under the majority of engine operating conditions.

SUMMARY OF THE INVENTION

According to the present invention, a turbomachine clearance control system comprises a casing which operationally surrounds the radially outer tips of an annular array of radially extending rotor aerofoil blades in coaxial radially spaced apart relationship, a plurality of shroud segments which cooperate to define an annular shroud interposed between the tips of said rotor aerofoil blades and said casing, each of said shroud segments having upstream, mid and downstream portions with respect to the operational fluid flow through said casing, the mid portion of each of said shroud segments being interconnected with said casing in such a manner that a limited degree of pivotal movement of each of said shroud segments relative to said casing is permitted to vary the clearances between the axial extents of each said shroud segments and said rotor aerofoil blade tips, means being provided to provide said pivotal movement.

The invention will now be described, by way of example, with reference to the accompanying drawings in which:

DETAILED DESCRIPTION OF THE INVENTION

Figure 1:
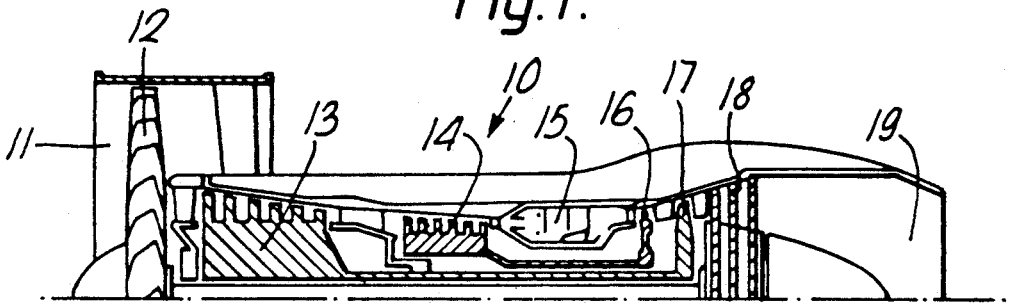
FIG. 1 is a sectioned side view of the upper half of a ducted fan gas turbine engine which incorporates a clearance control system in accordance with the present invention.

With reference to FIG. 1 a ducted fan gas turbine engine generally indicated at 10 comprises, in axial flow series, an air intake 11, a fan 12, an intermediate pressure compressor 13, a high pressure compressor 14, combustion equipment 15, a high pressure turbine 16, an intermediate pressure turbine 17, a low pressure turbine 18 and an exhaust nozzle 19. The engine 10 functions in the conventional manner whereby air drawn in through the air intake 11 is compressed by the fan 12. The air flow exhausted from the fan 12 is divided with a portion being utilised to provide propulsive thrust and the remainder directed into the intermediate pressure compressor 13. There the air is further compressed before being delivered to the high pressure compressor 14 where still further compression takes place. The compressed air is then directed into the combustion equipment 15 where it is mixed with fuel and the mixture combusted. The resultant hot combustion products then expand through the high intermediate and low pressure turbines 16,17,18 which are respectively drivingly interconnected with the high and intermediate pressure compressors 14 and 13 and the fan 12, before being exhausted through the nozzle 19 to provide additional propulsive thrust.

Figure 2:
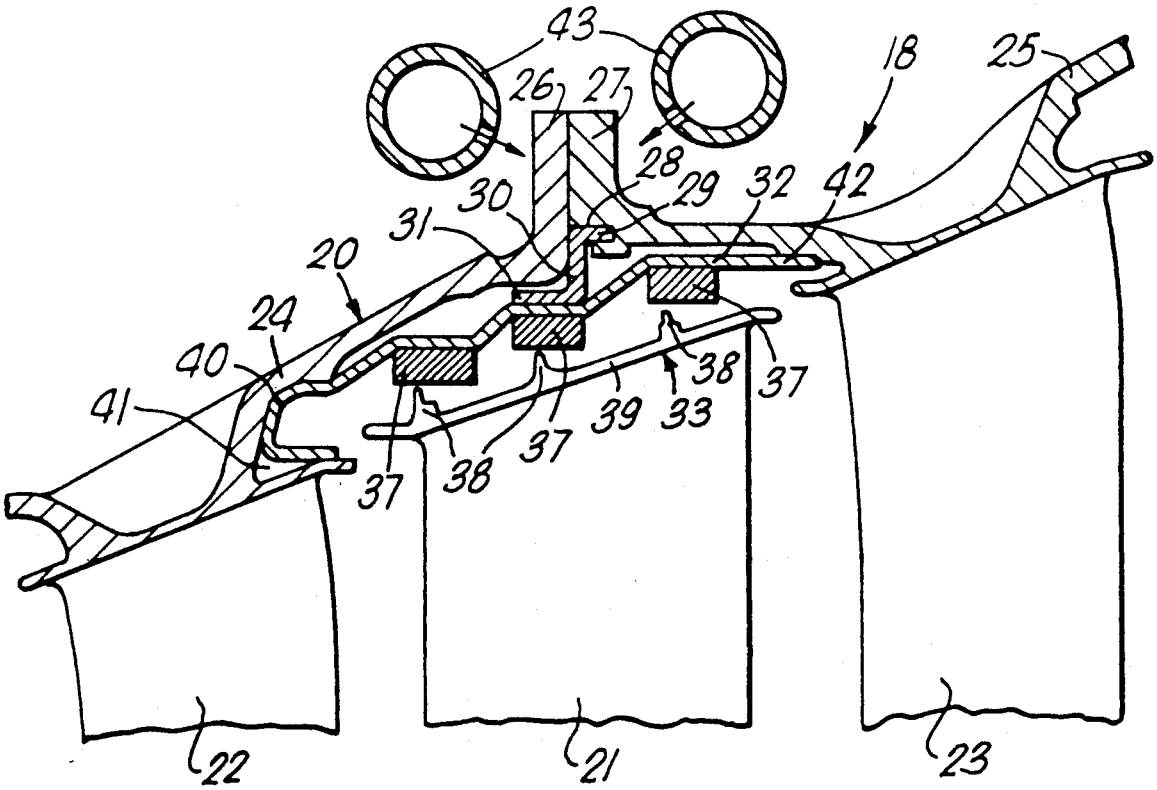
FIG. 2 is a sectioned side view on an enlarged scale of a portion of the low pressure turbine of the ducted fan gas turbine engine shown in FIG. 2 depicting the clearance control system in accordance with the present invention.

A portion of the low pressure turbine 18 can be seen more clearly if reference is made to FIG. 2. The low pressure turbine 18 comprises a casing 20 which encloses three annular arrays of rotor aerofoil blades, only one of which arrays 21 can be seen in FIG. 2. The rotor blade array 21 is axially interposed between two annular arrays 22 and 23 of stator aerofoil vanes in the conventional manner of axial flow turbines.

Each of the annular arrays of stator aerofoil vanes 22 and 23 is respectively located at its radially outer extent by and is integral with casing portions 24 and 25 although it will be appreciated that such an integral construction is not essential to the present invention. The casing portions 24 and 25 are respectively flanged at 26 and 27 to facilitate their interconnection by suitable means (not shown) to thereby define a portion of the low pressure turbine casing 20. The flanges 26 and 27 are located, immediately radially outwardly of rotor blade array 21.

The flange 27 in the downstream casing portion 25 is provided, at its radially inner extent, with an annular, axially directed groove 28. The groove 28 receives and supports one arm 29 of a substantially S-shaped cross-section support member 30. The other arm 31, which is substantially parallel with the arm 29, is attached to a shroud segment 32. There are a plurality of the support members 30 and shroud segments 32 mounted on the casing 20 so that the shroud segments 32 cooperate to define an annular shroud which surrounds the radial outer extents of the tips 33 of the aerofoil blades in the array 21.

Each shroud segment 32 is stepped in an axial direction so as to define three radially inwardly facing surfaces on each of which is located a circumferentially extending strip 37 of an abradable material. The abradable strips 37 confront radially and circumferentially extending ribs 38 which are located on platforms 39, one platform 39 being provided on each blade tip 33. Together the ribs 38 and abradable strips 37 cooperate to define three axially spaced apart seals which are intended to inhibit the leakage of hot combustion exhaust gases between the rotor blade tips 33 and the turbine casing 20.

The upstream end 40 of each shroud segment 32 is formed into a substantially C-shaped cross-section location feature which locates in a correspondingly shaped annular recess 41 defined between the annular array of stator aerofoil vanes 22 and the casing portion 24. This serves to provide radial fixing of the upstream ends 40 of the shroud segments 32 relative to the turbine casing 20.

The downstream ends 42 of the shroud segments are not so fixed. Instead they are free so that relative radial movement between each shroud segment downstream end 42 and the turbine casing 20 is possible.

During engine operation, hot combustion exhaust gases pass through the low pressure turbine 18 and inevitably cause a rise in the temperature of the various components which make up that turbine 18. Thermal expansion of those components results and this in turn leads to an increase in the clearance between the turbine blade sealing ribs 38 and the abradable strips 37, thereby resulting in increased turbine gas leakage over the blade tips 33 and a consequent fall in turbine efficiency. In order to counter this increase in turbine blade tip clearance, cooling air is directed on the casing flanges 26 and 27 via two apertured annular manifolds 43 which are located adjacent the flanges 26 and 27. Air for the manifolds 43 is derived by conventional means from the high pressure compressor 14 of the engine.

The localised cooling of the turbine casing 20 in the region of the flanges 26 and 27 results in a correspondingly localised thermal contraction of the casing 20. Since the shroud segments 32 are attached to the casing 20 in the region of the flanges 26 and 27 by means of the support members 30, then there is a resultant radially inward movement of the shroud segments 32 to reduce the clearances between the sealing ribs 38 and abradable strips 37, thereby improving the gas sealing provided thereby. It will be noted however that the portion of the casing 20 which provides radial support for the upstream ends 40 of the shroud segments are not cooled and therefore does not contract in the same manner as the cooled casing flanges 26 and 27. Thus whereas the centre portions of the shroud segments 32 move radially inwards as a result of the localised contraction of the casing 20, the upstream ends 40 of the shroud segments 32 do not. Since the downstream ends 42 of the shroud segments 32 are free, there is a resultant pivoting of each shroud segment 32 about its position of attachment to the casing 20 by the support member 30 which is facilitated by the flexing of the support member 30. This pivoting action provides an increase in the clearance between the upstream sealing ribs 38 and abradable strips 37 and a decrease in the clearance between the downstream sealing ribs 38 and abradable strips 37. Since in any multi-stage seal it is the last stage which provides the greatest sealing effect, then this pivoting of the shroud segments 32 provides an overall increase in the effectiveness of the seal between the rotor blade tips 33 and the shroud segments 32.

The flow rate of the cooling air may be modulated in order to provide the desired degree of cooling and consequent thermal contraction of the casing 20.

Although in the version of the present invention described above, cooling air is directed onto the casing 20 by means of the two manifolds 43, it will be appreciated that other means could be employed to so direct the air if so desired. Indeed under certain circumstances, air which operationally flows over the casing 20 could be sufficient to provide the necessary degree of cooling.

Figure 3:
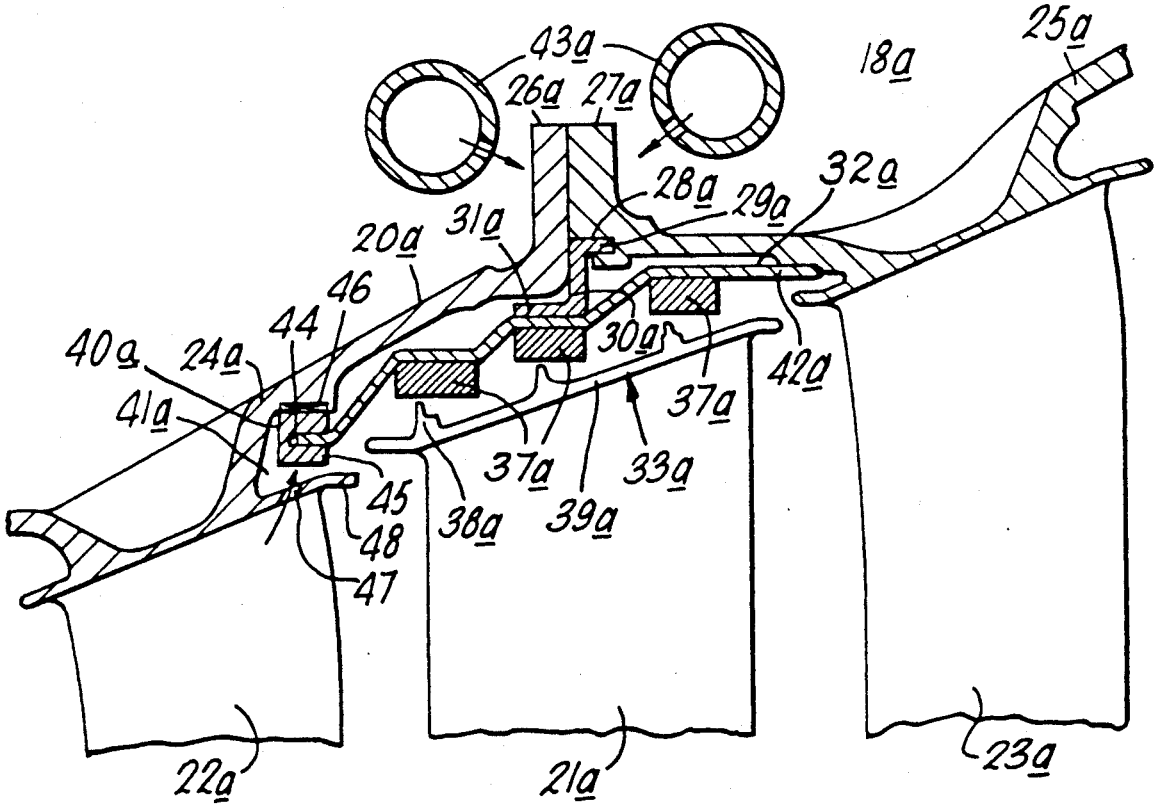
FIG. 3 is a view similar to that shown in FIG. 2 depicting an alternative form of clearance control system in accordance with the present invention.

In FIG. 3 there is shown a portion of the low pressure turbine 18 which is similar to that shown in FIG. 2 and accordingly features which are common to both turbine portions are suffixed by the letter a.

The major difference between the low pressure turbine 18 portions shown in FIGS. 2 and 3 resides in the manner in which the upstream ends 40 and **40*a* of the shroud segments 32 and 32*a* are supported. Thus whereas the upstream ends 40 of the shroud segments 32 are radially fixed relative to the turbine casing 20, this is not the case with the upstream ends 40*a* of the shroud segments 32*a*. Thus each of the upstream ends 40*a* of the shroud segments 32*a* locates in an axially directed circumferential slot 44 which is provided in a ring 45 formed from a metal having a high coefficient of thermal expansion compared with that of the casing 20*a***.

The ring 45 is located on a radially inner surface of the casing **20*a* by a conventional cross-key feature 46. The cross-key feature 46 prevents the rotation of the ring 45 relative to the casing 20*a* but permits the ring 45 to thermally expand and contract independently of the casing 20*a*. Thus although the shroud segments 32*a* are able to pivot in the same manner as the shroud segments 32, the extent of that pivoting action is governed by the radial position of the ring 45 relative to the turbine casing 20*a***.

In a typical situation in which the turbine 18 is functioning normally with hot combustion exhaust gases flowing over the blades 21 and vanes 22 and 23, the high thermal expansion ring 45 thermally expands to a greater extent than the turbine casing **20*a*. This has the effect of exaggerating the pivoting action of the shroud segments 32*a* so as to provide a further reduction in clearance between the downstream sealing ribs 38 and abradable strips 37. If such a further reduction is undesirable or unnecessary, the provision of the high thermal expansion ring 45 may still be desirable since it will be seen that for a given degree of shroud segment 32*a* pivoting, less cooling of the casing flanges 26 and 27 will be necessary with the ring 45 present than with the ring 45** absent.

In order to enhance the heating of the ring 45 holes 47 may be provided in the outer platforms 48 of the stator vanes 22*a* in order to a hot combustion exhaust gas flow directly on to the ring 45.

It will be seen therefore that in both of the embodiments of the present invention which are described above, a larger variation in rotor blade tip clearance can be achieved than would be the case if a simple system of external cooling of the turbine casing were to be employed.

Although the present invention has been described with reference to a low pressure turbine in which permanent casing cooling is provided, it will be appreciated that other turbine portions could employ the present invention and that the cooling air flow could be modulated in accordance with an appropriate engine operating parameter.

We claim:

1. A turbomachine clearance control system comprising a casing, an annular array of radially extending rotor aerofoil blades in coaxial radially spaced apart relationship, said casing operationally surrounding the radially outer tips of said rotor aerofoil blades, a plurality of shroud segments which cooperate to define an annular shroud interposed between the tips of said rotor aerofoil blades and said casing, each of said shroud segments having upstream, mid and downstream portion with respect to the operational fluid flow through said casing, the mid portion of each of said shroud segments being interconnected with said casing in such a manner that a limited degree of pivotal movement of each of said shroud segments relative to said casing is permitted to vary the clearances between the axial extents of each of said shroud segments and said rotor aerofoil blade tips, means being provided to provide said pivotal movement, wherein each of said shroud segments has an upstream end restrained against radial displacement, means being provided to operationally cool said casing in the region of the pivotal connection thereto of said shroud segments so as to cause said casing to locally thermally contact relative to said upstream shroud segment end and thereby provide said shroud segment pivotal movement.

2. A turbomachine clearance control system as claimed in claim 1 wherein each of said shroud segments is attached at its upstream end to said casing so that relative radial movement between said shroud segment upstream ends and said casing is prevented.

3. A turbomachine clearance control system as claimed in claim 1 wherein each of said shroud segments is attached at its upstream end to a ring which is coaxially disposed within said casing, said ring having a coefficient of thermal expansion which is higher than that of said casing, said ring being located in such a manner as to be permitted to thermally expand and contract independently of said casing.

4. A turbomachine clearance control system as claimed in claim 3 wherein said ring is located from said casing by a cross-key location feature which permits said thermal expansion and contraction of said ring independently of said casing.

5. A turbomachine clearance control system as claimed in claim 3 wherein means are provided for the direction of a flow of hot fluid on to said ring so as to enhance the thermal expansion of said ring.

6. A turbomachine clearance control system as claimed in claim 1 wherein each of said shroud segment mid-portions interconnected with said casing is so interconnected by means of a member which is sufficiently flexible as to provide said limited pivotal movement.

7. A turbomachine clearance control system as claimed in claim 1 wherein each of said rotor aerofoil blades is provided with a platform at its radially outer tip, each of said platforms being provided on its radially outer surface with ribs which extend both radially and circumferentially so as to cooperate with said shroud segments to define fluid seals.

8. A turbomachine clearance control system as claimed in claim 1 wherein said casing is flanged in said region of inconnection thereof with said shroud segments, said means provided to operationally cool said casing being adapted to direct cooling fluid on to said flanges.

9. A gas turbine engine including a turbomachine clearance control system comprising a casing, an annular array of radially extending rotor aerofoil blades in coaxial radially spaced apart relationship, said casing operationally surrounding the radially outer tips of said rotor aerofoil blades, a plurality of shroud segments which cooperate to define an annular shroud interposed between the tips of said rotor aerofoil blades and said casing, each of said shroud segments having upstream, mid and downstream portions with respect to the operational fluid flow through said casing, the mid portion of each of said shroud segments being interconnected with said casing in such a manner that a limited degree of pivotal movement of each of said shroud segments relative to said casing is permitted to vary the clearances between the axial extents of each of said shroud segments and said rotor aerofoil blade tips, means being provided to provide said pivotal movement, wherein each of said shroud segments has an upstream end restrained against radial displacement, means being provided to operationally cool said casing in the region of the pivotal connection thereto of said shroud segments so as to cause said casing to locally thermally contract relative to said upstream shroud segment end and thereby provide said shroud segment pivotal movement.

* * * * *